United States Patent [19]

Schwarz

[11] 4,318,553

[45] Mar. 9, 1982

[54] SKI ATTACHMENT

[76] Inventor: Günter Schwarz, Steinacherstrasse 67, CH-8804 Au/Zuerich, Switzerland

[21] Appl. No.: 109,341

[22] Filed: Jan. 3, 1980

[30] Foreign Application Priority Data

Jan. 8, 1979 [CH] Switzerland ..... 112/79

[51] Int. Cl.[3] ..... A63C 11/02

[52] U.S. Cl. ..... 280/814; 280/817

[58] Field of Search ..... 280/814, 817; 24/73 SG; 224/45 S, 917

[56] References Cited

U.S. PATENT DOCUMENTS

| | | | |
|---|---|---|---|
| 3,936,067 | 2/1976 | Link | 280/814 |
| 4,047,726 | 9/1977 | Kokeisl | 280/817 |
| 4,135,729 | 1/1979 | Brangenberg | 280/817 |

FOREIGN PATENT DOCUMENTS

| | | | |
|---|---|---|---|
| 183000 | 1/1955 | Austria | 280/814 |
| 2441590 | 3/1975 | Fed. Rep. of Germany | 280/817 |
| 2647201 | 10/1977 | Fed. Rep. of Germany | 280/814 |
| 2824642 | 12/1979 | Fed. Rep. of Germany | 280/814 |

*Primary Examiner*—David M. Mitchell

*Attorney, Agent, or Firm*—Toren, McGeady and Stanger

[57] ABSTRACT

A ski attachment is provided with a vertically directed slot-like opening bounded by two parts which project upwards from its base plate. As the ski attachment can be fixed to a ski in easily detachable manner, it can serve in the detached state as a clip for holding together a pair of skis by introducing the skis into the slot-like opening. The skis of one pair then engage with one another within the attachment by their contact surfaces.

8 Claims, 4 Drawing Figures

Fig. 1
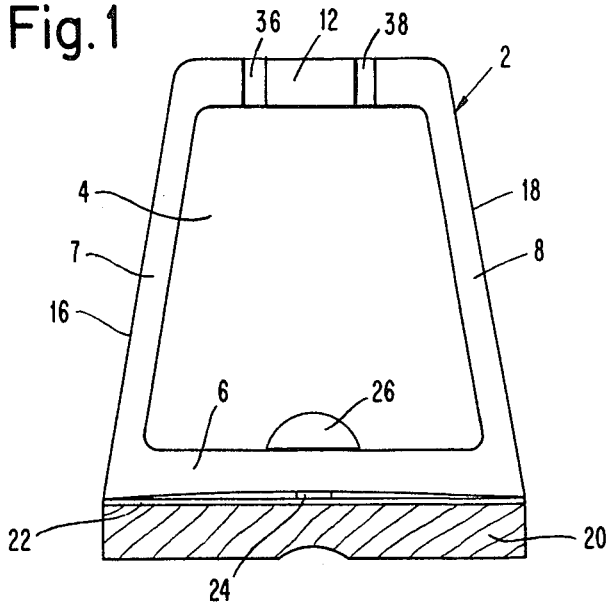
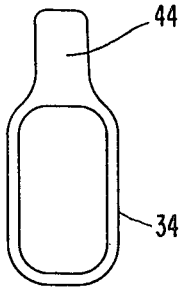
Fig. 4
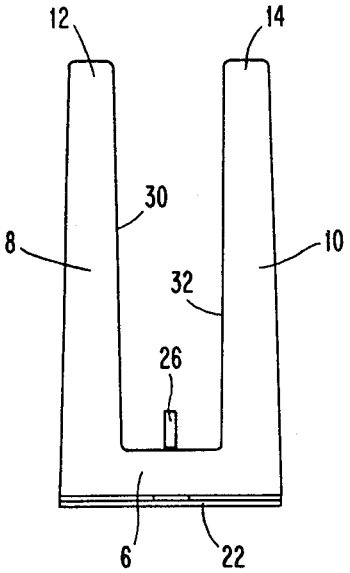
Fig. 2
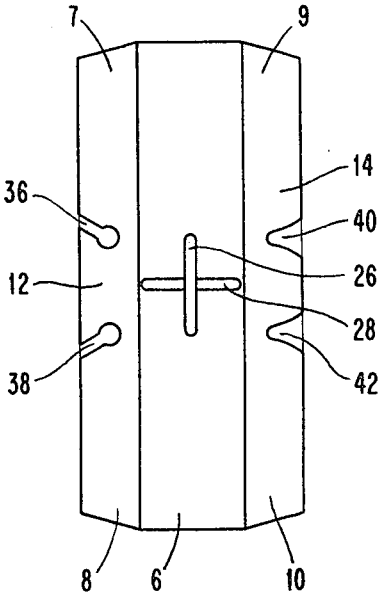
Fig. 3

SKI ATTACHMENT

SUMMARY OF THE INVENTION

The invention relates to a ski attachment for preventing the crossing of skis when skiing. The invention solves the problem of enabling the ski attachment to fulfil the further function, of holding the skis together during transportation. Hitherto it has been conventional practice for this transporting function to use separate means such as straps, and the like. This problem is solved by the features of the ski attachment embodying the present invention.

According to the invention, a ski attachment is provided for each ski of a pair of skis so that the ski attachment can be used for holding together the skis in the blade area and at the ends of the skis.

The invention is explained in greater detail hereinafter relative to the drawings.

BRIEF DESCRIPTION OF THE DRAWING

FIG. 1 a front view of the ski attachment, viewed in the longitudinal direction of the ski.

FIG. 2 a side view of the attachment of FIG. 1.

FIG. 3 is a plan view of the attachment of FIG. 1.

FIG. 4 a plan view of a rubber-elastic member.

DETAILED DESCRIPTION OF THE INVENTION

Viewed in the longitudinal direction of the ski the ski attachment 2 is trapezoidal and has a snow opening 4. Four members 7 to 10 extend upwardly from a plate-like base portion 6 and are interconnected in pairs by in each case one transverse member 12, 14 so that the combination of two upwardly extending members and an interconnecting transverse member forms a U-shaped part. The outer surfaces 16, 18 of members 7 to 10 form one side of attachment 2, and depending on whether the outer surface is positioned on the right or left side of the ski 20, in contact with a ski edge, and it prevents the undesired and dangerous crossing of the skis when skiing.

The attachment 2 is mounted on the ski in an easily detachable manner. To this end a metal plate 22, whose size corresponds to the plate-like base ortion 6 of the attachment is adhered to the top of the ski in the blade area. Starting from metal plate 22 a fastening extension extends upwardly through the base portion 6 and is locked to the top of the base portion by the relative twisting of its flat head 26. To this end the flat head 26 is passed through a slot 28 in the base portion, so that the attachment can be detached from the metal plate 22 and, therefore, from the ski. The device for the detachable fixing is only shown in an exemplified and diagrammatic manner, because various constructions thereof are known.

The two attachments 2 of a pair of skis can be placed from the side in clip-like manner over the skis, whose contact surfaces are placed against one another, so that the skis can be held together and easily transported. The pairs of members 7, 8 and 9, 10, together with the transverse members 12, 14 surround the pair of skis from both sides. By firstly placing the attachment 2 over the thinnest areas of the skis, i.e. in the area of the blade and the end, and subsequently moving them to a thicker area, the skis are secured relative to one another. A reliable holding of the ski attachments 2 in the transporting position is brought about if the inner surfaces 30, 32 of the pairs of members which come into contact with the tops of the skis are formed from a material with good adhesion, such as rubber and the like.

However, it is also advantageous to place a connecting member 34 over the outer ends of the pairs of members and/or from one transverse member 12, 14 to the other, so that the attachment together with part of its base plate 6, the pairs of members 7, 8 or 9, 10 and the connecting member 34 completely surround the pair of skis.

The connecting member 34 can comprise a rubber ring, as shown in FIG. 4. The rubber ring is placed in slots 36, 38 of the transverse member 12 on one upper side of the ski attachment, it is then secured over the skis introduced into the attachment, and is placed in cutouts 40, 42 in the transverse member 14 on the opposite side of the upper side of the attachment. Operation of the rubber ring can be facilitated by a gripping tab 44 on one or two facing peripheral points of the rubber ring.

It is obvious that transverse members 12, 14 can be interconnected by numerous other means, so that after the at least one-sided detachment of such connecting means the two skis can be introduced into the gap between the pairs of members. Such connecting means can be constructed in cap or flap-like manner by shaping engagement and detachment means into or onto the transverse members 12, 14. In the case of a flap-like construction, a swivel connection, e.g. a hinge, can be provided on one transverse member 12 and a locking device or the like on the other transverse member 14. It is obviously possible to provide a mounting space for a pair of skis on differently constructed attachments, i.e. not shaped like a hollow trapezium, so that two parts of the attachment engage the pair of skis in clip-like manner.

I claim:

1. Ski attachment comprising a base portion having a dimension corresponding to the ski width, at least one part extending upwardly from said base portion and having a surface facing outwardly from the side of the ski to which it is attached and facing toward the other ski of a pair for preventing the crossing of the skis of the pair during skiing, and means for detachably fixing said attachment to the ski, wherein the improvement comprises two separate said parts extending upwardly from said base portion and being spaced apart by a dimension at least twice the thickness of the thinnest area of the skis on which said attachment is used for forming together with said base portion a clamp by which a pair of skis may be clamped together within the space between said two parts with the opening to the space being located outwardly from said base portion.

2. Ski attachment, as set forth in claim 1, wherein said upwardly extending parts each extend transversely across the ski and have an inverted U-shape and comprise a pair of upwardly extending legs laterally spaced apart with each said leg connected at one end to said base portion, and a transverse member formed integrally with and interconnecting the other ends of said legs.

3. Ski attachment, as set forth in claim 1, including means for interconnecting the upper ends of said parts spaced from said base portion thereof for biasing said parts together when the ski attachment is used for clamping a pair of skis together.

4. Ski attachment, as set forth in claim 3, wherein each said part comprises a pair of members disposed in laterally spaced apart relation extending upwardly from said base portion, a transverse member interconnecting the upper ends of said upwardly extending members, and said interconnecting means comprises a rubber-elastic member detachably engageable with said transverse members of each of said parts for forming a closure extending between said transverse members.

5. Ski attachment, as set forth in claim 4, wherein said rubber-elastic member comprises a rubber ring, mounting slots formed in each of said transverse members, said rubber ring being detachably engageable in said mounting slots in said transverse member.

6. Ski attachment, as set forth in claim 5, said rubber ring having a gripping tab secured to and extending outwardly therefrom for use in placing said rubber ring on and removing it from said ski attachment.

7. Ski attachment, as set forth in claim 1, wherein said upwardly extending parts are formed integrally with said base portion and extend across the ski in the width direction thereof, said upwardly extending parts each having surfaces facing the other and disposed in spaced relation with the space between said facing surfaces in combination with said base portion defining the space within which a pair of skis can be clamped.

8. Ski attachment, as set forth in claim 7, wherein said upwardly extending parts have an inverted U-shape and each comprises a pair of upwardly extending legs spaced apart with each said leg connected at the lower end thereof to said base portion, and a transverse member formed integrally with and interconnecting the other ends of said legs of each said upwardly extending part.

* * * * *